US007532179B2

(12) United States Patent
Yang et al.

(10) Patent No.: US 7,532,179 B2
(45) Date of Patent: May 12, 2009

(54) METHOD OF DISPLAYING GRAY SCALES OF PLASMA DISPLAY PANEL, AND PLASMA DISPLAY DEVICE

(75) Inventors: Jin-Ho Yang, Suwon-si (KR); Woo-Joon Chung, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 585 days.

(21) Appl. No.: 11/135,344

(22) Filed: May 24, 2005

(65) Prior Publication Data

US 2006/0007066 A1 Jan. 12, 2006

(30) Foreign Application Priority Data

May 25, 2004 (KR) ..... 10-2004-0037296

(51) Int. Cl.
*G09G 3/28* (2006.01)

(52) U.S. Cl. ..... 345/63; 345/690

(58) Field of Classification Search ..... 345/60, 345/63, 68, 690, 691, 692; 315/169.1, 169.4
See application file for complete search history.

(56) References Cited

U.S. PATENT DOCUMENTS 6,215,469 B1 4/2001 Mori
6,496,194 B1 * 12/2002 Mikoshiba et al. ..... 345/596
6,646,625 B1 11/2003 Shigeta
2005/0078060 A1 * 4/2005 Shigeta et al. ..... 345/63

FOREIGN PATENT DOCUMENTS

| | | |
|---|---|---|
| CN | 1201216 | 12/1998 |
| CN | 1290386 | 4/2001 |
| CN | 1144169 | 5/2001 |
| CN | 1313980 | 9/2001 |
| JP | 2001092409 | 4/2001 |

* cited by examiner

*Primary Examiner*—Regina Liang
*Assistant Examiner*—Shaheda A Abdin
(74) *Attorney, Agent, or Firm*—H.C. Park & Associates, PLC

(57) ABSTRACT

A method of expressing gray scales of a plasma panel display using the sum of weights assigned to subfields, including extracting a first gray scale arrangement including gray scale n using (k−1) subfields to gray scale m using k subfields from a second gray scale arrangement including gray scale 1 to gray scale m using k subfields between the 1st and the jth subfields when the number of subfields used for gray scale (i+1) is the same or greater than the number of subfields used for gray scale i, and generating a third gray scale arrangement including gray scales (n+p) to (m+p) by adding a weight p of the (j+1)th subfield to the first gray subfield arrangement including the gray scales n to m.

15 Claims, 11 Drawing Sheets

| Weight | SF1 | SF2 | SF3 | SF4 | SF5 | SF6 | The number |
|---|---|---|---|---|---|---|---|
| | 1 | 2 | 3 | 5 | 8 | 11 | of subfields |
| Gray scale | | | | | | | |
| 0 | | | | | | | 0 |
| 1 | 1 | | | | | | 1 |
| 2 | | 1 | | | | | 1 |
| 3 | 1 | 1 | | | | | 2 |
| 4 | 1 | | 1 | | | | 2 |
| 5 | | 1 | 1 | | | | 2 |
| 6 | 1 | | | 1 | | | 2 |
| 7 | | 1 | | 1 | | | 2 |
| 8 | 1 | 1 | | 1 | | | 3 |
| 9 | 1 | | 1 | 1 | | | 3 |
| 10 | | 1 | 1 | 1 | | | 3 |
| 11 | 1 | 1 | | | 1 | | 3 |
| 12 | 1 | | 1 | | 1 | | 3 |
| 13 | | 1 | 1 | | 1 | | 3 |
| 14 | 1 | | | 1 | 1 | | 3 |
| 15 | | 1 | | 1 | 1 | | 3 |
| 16 | 1 | 1 | | 1 | 1 | | 4 |
| 17 | 1 | | 1 | 1 | 1 | | 4 |
| 18 | | 1 | 1 | 1 | 1 | | 4 |
| 19 | 1 | 1 | | 1 | | 1 | 4 |
| 20 | 1 | | 1 | 1 | | 1 | 4 |
| 21 | | 1 | 1 | 1 | | 1 | 4 |
| 22 | 1 | 1 | | | 1 | 1 | 4 |
| 23 | 1 | | 1 | | 1 | 1 | 4 |
| 24 | | 1 | 1 | | 1 | 1 | 4 |
| 25 | 1 | | | 1 | 1 | 1 | 4 |
| 26 | | 1 | | 1 | 1 | 1 | 4 |
| 27 | 1 | 1 | | 1 | 1 | 1 | 5 |
| 28 | 1 | | 1 | 1 | 1 | 1 | 5 |
| 29 | | 1 | 1 | 1 | 1 | 1 | 5 |

FIG. 1 (Prior Art)

| Gray scale | 1 | 2 | 4 | 8 | 16 | |
|---|---|---|---|---|---|---|
| Light emission | 2.0 | 3.4 | 6.2 | 11.8 | 23.0 | Brightness |
| 1 | 1 | | | | | 2 |
| 2 | | 1 | | | | 3.4 |
| 3 | 1 | 1 | | | | 5.4 |
| 4 | | | 1 | | | 6.2 |
| 5 | 1 | | 1 | | | 8.2 |
| 6 | | 1 | 1 | | | 9.6 |
| 7 | 1 | 1 | 1 | | | 11.6 |
| 8 | | | | 1 | | 11.8 |
| 9 | 1 | | | 1 | | 13.8 |
| 10 | | 1 | | 1 | | 15.2 |
| 11 | 1 | 1 | | 1 | | 17.2 |
| 12 | | | 1 | 1 | | 18 |
| 13 | 1 | | 1 | 1 | | 20 |
| 14 | | 1 | 1 | 1 | | 21.4 |
| 15 | 1 | 1 | 1 | 1 | | 23.4 |
| 16 | | | | | 1 | 23 |
| 17 | 1 | | | | 1 | 25 |
| 18 | | 1 | | | 1 | 26.4 |
| 19 | 1 | 1 | | | 1 | 28.4 |
| 20 | | | 1 | | 1 | 29.2 |
| 21 | 1 | | 1 | | 1 | 31.2 |
| 22 | | 1 | 1 | | 1 | 32.6 |
| 23 | 1 | 1 | 1 | | 1 | 34.6 |
| 24 | | | | 1 | 1 | 34.8 |
| 25 | 1 | | | 1 | 1 | 36.8 |
| 26 | | 1 | | 1 | 1 | 38.2 |
| 27 | 1 | 1 | | 1 | 1 | 40.2 |
| 28 | | | 1 | 1 | 1 | 41 |
| 29 | 1 | | 1 | 1 | 1 | 43 |
| 30 | | 1 | 1 | 1 | 1 | 44.4 |
| 31 | 1 | 1 | 1 | 1 | 1 | 46.4 |

FIG. 3A

| Weight | SF1 | SF2 | SF3 | SF4 | SF5 | The number of subfields |
|---|---|---|---|---|---|---|
| | 1 | 2 | 3 | 5 | 8 | |
| Gray scale | | | | | | |
| 0 | | | | | | 0 |
| 1 | 1 | | | | | 1 |
| 2 | | 1 | | | | 1 |
| 3 | 1 | 1 | | | | 2 |
| 4 | 1 | | 1 | | | 2 |
| 5 | | 1 | 1 | | | 2 |
| 6 | 1 | | | 1 | | 2 |
| 7 | | 1 | | 1 | | 2 |
| 8 | 1 | 1 | | 1 | | 3 |
| 9 | 1 | | 1 | 1 | | 3 |
| 10 | | 1 | 1 | 1 | | 3 |
| ~~11~~ | ~~1~~ | ~~1~~ | ~~1~~ | ~~1~~ | | |
| 11 | 1 | 1 | | | 1 | 3 |
| 12 | 1 | | 1 | | 1 | 3 |
| 13 | | 1 | 1 | | 1 | 3 |
| 14 | 1 | | | 1 | 1 | 3 |
| 15 | | 1 | | 1 | 1 | 3 |
| 16 | 1 | 1 | | 1 | 1 | 4 |
| 17 | 1 | | 1 | 1 | 1 | 4 |
| 18 | | 1 | 1 | 1 | 1 | 4 |

FIG. 3B

| Weight | SF1 | SF2 | SF3 | SF4 | SF5 | SF6 | The number of subfields |
|---|---|---|---|---|---|---|---|
| | 1 | 2 | 3 | 5 | 8 | 11 | |
| Gray scale | | | | | | | |
| 0 | | | | | | | 0 |
| 1 | 1 | | | | | | 1 |
| 2 | | 1 | | | | | 1 |
| 3 | 1 | 1 | | | | | 2 |
| 4 | 1 | | 1 | | | | 2 |
| 5 | | 1 | 1 | | | | 2 |
| 6 | 1 | | | 1 | | | 2 |
| 7 | | 1 | | 1 | | | 2 |
| 8 | 1 | 1 | | 1 | | | 3 |
| 9 | 1 | | 1 | 1 | | | 3 |
| 10 | | 1 | 1 | 1 | | | 3 |
| 11 | 1 | 1 | | | 1 | | 3 |
| 12 | 1 | | 1 | | 1 | | 3 |
| 13 | | 1 | 1 | | 1 | | 3 |
| 14 | 1 | | | 1 | 1 | | 3 |
| 15 | | 1 | | 1 | 1 | | 3 |
| 16 | 1 | 1 | | 1 | 1 | | 4 |
| 17 | 1 | | 1 | 1 | 1 | | 4 |
| 18 | | 1 | 1 | 1 | 1 | | 4 |
| 19 | 1 | 1 | | 1 | | 1 | 4 |
| 20 | 1 | | 1 | 1 | | 1 | 4 |
| 21 | | 1 | 1 | 1 | | 1 | 4 |
| 22 | 1 | 1 | | | 1 | 1 | 4 |
| 23 | 1 | | 1 | | 1 | 1 | 4 |
| 24 | | 1 | 1 | | 1 | 1 | 4 |
| 25 | 1 | | | 1 | 1 | 1 | 4 |
| 26 | | 1 | | 1 | 1 | 1 | 4 |
| 27 | 1 | 1 | | 1 | 1 | 1 | 5 |
| 28 | 1 | | 1 | 1 | 1 | 1 | 5 |
| 29 | | 1 | 1 | 1 | 1 | 1 | 5 |

FIG. 3C

| Weight | SF1 | SF2 | SF3 | SF4 | SF5 | SF6 | The number of subfields |
|---|---|---|---|---|---|---|---|
| | 1 | 2 | 3 | 5 | 8 | 12 | |
| Gray scale | | | | | | | |
| 0 | | | | | | | 0 |
| 1 | 1 | | | | | | 1 |
| 2 | | 1 | | | | | 1 |
| 3 | 1 | 1 | | | | | 2 |
| 4 | 1 | | 1 | | | | 2 |
| 5 | | 1 | 1 | | | | 2 |
| 6 | 1 | | | 1 | | | 2 |
| 7 | | 1 | | 1 | | | 2 |
| 8 | 1 | 1 | | 1 | | | 3 |
| 9 | 1 | | 1 | 1 | | | 3 |
| 10 | | 1 | 1 | 1 | | | 3 |
| 11 | 1 | 1 | | | 1 | | 3 |
| 12 | 1 | | 1 | | 1 | | 3 |
| 13 | | 1 | 1 | | 1 | | 3 |
| 14 | 1 | | | 1 | 1 | | 3 |
| 15 | | 1 | | 1 | 1 | | 3 |
| ~~16~~ | ~~1~~ | ~~1~~ | | ~~1~~ | ~~1~~ | | 4 |
| ~~17~~ | ~~1~~ | | ~~1~~ | ~~1~~ | ~~1~~ | | 4 |
| ~~18~~ | | ~~1~~ | ~~1~~ | ~~1~~ | ~~1~~ | | 4 |
| 16 | 1 | | 1 | | | 1 | 3 |
| 17 | | 1 | 1 | | | 1 | 3 |
| 18 | 1 | | | 1 | | 1 | 3 |
| 19 | | 1 | | 1 | | 1 | 3 |
| 20 | 1 | | 1 | 1 | | 1 | 4 |
| 21 | 1 | 1 | | 1 | | 1 | 4 |
| 22 | | 1 | 1 | 1 | | 1 | 4 |
| 23 | 1 | 1 | | | 1 | 1 | 4 |
| 24 | 1 | | 1 | | 1 | 1 | 4 |
| 25 | | 1 | 1 | | 1 | 1 | 4 |
| 26 | 1 | | | 1 | 1 | 1 | 4 |
| 27 | | 1 | | 1 | 1 | 1 | 4 |

*FIG. 4A*

| Weight | 1 | 2 | 3 | 5 | 8 | 13 | 20 | 32 | 45 | 57 | 69 | The number of subfields |
|---|---|---|---|---|---|---|---|---|---|---|---|---|
| Gray scale | | | | | | | | | | | | |
| 1 | 1 | | | | | | | | | | | 1 |
| 2 | | 1 | | | | | | | | | | 1 |
| 3 | 1 | 1 | | | | | | | | | | 2 |
| 4 | 1 | | 1 | | | | | | | | | 2 |
| 5 | | 1 | 1 | | | | | | | | | 2 |
| 6 | 1 | 1 | 1 | | | | | | | | | 3 |
| 6 | 1 | | | 1 | | | | | | | | 2 |
| 7 | | 1 | | 1 | | | | | | | | 2 |
| 8 | 1 | 1 | | 1 | | | | | | | | 3 |
| 9 | 1 | | 1 | 1 | | | | | | | | 3 |
| 10 | | 1 | 1 | 1 | | | | | | | | 3 |
| 11 | 1 | 1 | 1 | 1 | | | | | | | | 4 |
| 11 | 1 | 1 | | | 1 | | | | | | | 3 |
| 12 | 1 | | 1 | | 1 | | | | | | | 3 |
| 13 | | 1 | 1 | | 1 | | | | | | | 3 |
| 14 | 1 | | | 1 | 1 | | | | | | | 3 |
| 15 | | 1 | | 1 | 1 | | | | | | | 3 |
| 16 | 1 | 1 | | 1 | 1 | | | | | | | 4 |
| 17 | 1 | | 1 | 1 | 1 | | | | | | | 4 |
| 18 | | 1 | 1 | 1 | 1 | | | | | | | 4 |
| 19 | 1 | 1 | 1 | 1 | 1 | | | | | | | 5 |
| 16 | 1 | 1 | | | | 1 | | | | | | 3 |
| 17 | 1 | | 1 | | | 1 | | | | | | 3 |
| 18 | | 1 | 1 | | | 1 | | | | | | 3 |
| 19 | 1 | | | 1 | | 1 | | | | | | 3 |
| 20 | | 1 | | 1 | | 1 | | | | | | 3 |
| 21 | 1 | 1 | | 1 | | 1 | | | | | | 4 |
| 22 | 1 | | 1 | 1 | | 1 | | | | | | 4 |
| 23 | | 1 | 1 | 1 | | 1 | | | | | | 4 |
| 24 | 1 | 1 | | | 1 | 1 | | | | | | 4 |
| 25 | 1 | | 1 | | 1 | 1 | | | | | | 4 |
| 26 | | 1 | 1 | | 1 | 1 | | | | | | 4 |
| 27 | 1 | | | 1 | 1 | 1 | | | | | | 4 |
| 28 | | 1 | | 1 | 1 | 1 | | | | | | 4 |
| 29 | 1 | 1 | | 1 | 1 | 1 | | | | | | 5 |
| 30 | 1 | | 1 | 1 | 1 | 1 | | | | | | 5 |
| 31 | | 1 | 1 | 1 | 1 | 1 | | | | | | 5 |
| 32 | 1 | 1 | 1 | 1 | 1 | 1 | | | | | | 6 |
| 29 | 1 | | 1 | 1 | | | 1 | | | | | 4 |
| 30 | | 1 | 1 | 1 | | | 1 | | | | | 4 |
| 31 | 1 | 1 | | | 1 | | 1 | | | | | 4 |
| 32 | 1 | | 1 | | 1 | | 1 | | | | | 4 |
| 33 | | 1 | 1 | | 1 | | 1 | | | | | 4 |
| 34 | 1 | | | 1 | 1 | | 1 | | | | | 4 |
| 35 | | 1 | | 1 | 1 | | 1 | | | | | 4 |
| 36 | 1 | 1 | | | | 1 | 1 | | | | | 4 |
| 37 | 1 | | 1 | | | 1 | 1 | | | | | 4 |
| 38 | | 1 | 1 | | | 1 | 1 | | | | | 4 |
| 39 | 1 | | | 1 | | 1 | 1 | | | | | 4 |
| 40 | | 1 | | 1 | | 1 | 1 | | | | | 4 |

*FIG. 4B*

| | | | | | | | | | | | | |
|---|---|---|---|---|---|---|---|---|---|---|---|---|
| 41 | 1 | 1 | | 1 | | 1 | 1 | | | | | 5 |
| 42 | 1 | | 1 | 1 | | 1 | 1 | | | | | 5 |
| 43 | | 1 | 1 | 1 | | 1 | 1 | | | | | 5 |
| 44 | 1 | 1 | | | 1 | 1 | 1 | | | | | 5 |
| 45 | 1 | | 1 | | 1 | 1 | 1 | | | | | 5 |
| 46 | | 1 | 1 | | 1 | 1 | 1 | | | | | 5 |
| 47 | 1 | | | 1 | 1 | 1 | 1 | | | | | 5 |
| 48 | | 1 | | 1 | 1 | 1 | 1 | | | | | 5 |
| 49 | 1 | 1 | | 1 | 1 | 1 | 1 | | | | | 6 |
| 50 | 1 | | 1 | 1 | 1 | 1 | 1 | | | | | 6 |
| 51 | | 1 | 1 | 1 | 1 | 1 | 1 | | | | | 6 |
| 52 | 1 | 1 | 1 | 1 | 1 | 1 | 1 | | | | | 7 |
| 41 | 1 | | 1 | 1 | | | | 1 | | | | 4 |
| 42 | | 1 | 1 | 1 | | | | 1 | | | | 4 |
| 43 | 1 | 1 | | | 1 | | | 1 | | | | 4 |
| 44 | 1 | | 1 | | 1 | | | 1 | | | | 4 |
| 45 | | 1 | 1 | | 1 | | | 1 | | | | 4 |
| 46 | 1 | | | 1 | 1 | | | 1 | | | | 4 |
| 47 | | 1 | | 1 | 1 | | | 1 | | | | 4 |
| 48 | 1 | 1 | | | | 1 | | 1 | | | | 4 |
| 49 | 1 | | 1 | | | 1 | | 1 | | | | 4 |
| 50 | | 1 | 1 | | | 1 | | 1 | | | | 4 |
| 51 | 1 | | | 1 | | 1 | | 1 | | | | 4 |
| 52 | | 1 | | 1 | | 1 | | 1 | | | | 4 |
| 53 | 1 | 1 | | 1 | | 1 | | 1 | | | | 5 |
| 54 | 1 | | 1 | 1 | | 1 | | 1 | | | | 5 |
| 55 | | 1 | 1 | 1 | | 1 | | 1 | | | | 5 |
| 56 | 1 | 1 | | | 1 | 1 | | 1 | | | | 5 |
| 57 | 1 | | 1 | | 1 | 1 | | 1 | | | | 5 |
| 58 | | 1 | 1 | | 1 | 1 | | 1 | | | | 5 |
| 59 | 1 | | | 1 | 1 | 1 | | 1 | | | | 5 |
| 60 | | 1 | | 1 | 1 | 1 | | 1 | | | | 5 |
| 61 | 1 | | 1 | 1 | | | 1 | 1 | | | | 5 |
| 62 | | 1 | 1 | 1 | | | 1 | 1 | | | | 5 |
| 63 | 1 | 1 | | | 1 | | 1 | 1 | | | | 5 |
| 64 | 1 | | 1 | | 1 | | 1 | 1 | | | | 5 |
| 65 | | 1 | 1 | | 1 | | 1 | 1 | | | | 5 |
| 66 | 1 | | | 1 | 1 | | 1 | 1 | | | | 5 |
| 67 | | 1 | | 1 | 1 | | 1 | 1 | | | | 5 |
| 68 | 1 | 1 | | | | 1 | 1 | 1 | | | | 5 |
| 69 | 1 | | 1 | | | 1 | 1 | 1 | | | | 5 |
| 70 | | 1 | 1 | | | 1 | 1 | 1 | | | | 5 |
| 71 | 1 | | | 1 | | 1 | 1 | 1 | | | | 5 |
| 72 | | 1 | | 1 | | 1 | 1 | 1 | | | | 5 |
| 73 | 1 | 1 | | 1 | | 1 | 1 | 1 | | | | 6 |
| 74 | 1 | | 1 | 1 | | 1 | 1 | 1 | | | | 6 |
| 75 | | 1 | 1 | 1 | | 1 | 1 | 1 | | | | 6 |
| 76 | 1 | 1 | | | 1 | 1 | 1 | 1 | | | | 6 |
| 77 | 1 | | 1 | | 1 | 1 | 1 | 1 | | | | 6 |
| 78 | | 1 | 1 | | 1 | 1 | 1 | 1 | | | | 6 |
| 79 | 1 | | | 1 | 1 | 1 | 1 | 1 | | | | 6 |
| 80 | | 1 | | 1 | 1 | 1 | 1 | 1 | | | | 6 |

*FIG. 4C*

| | | | | | | | | | | | | |
|---|---|---|---|---|---|---|---|---|---|---|---|---|
| 81 | 1 | 1 | | 1 | 1 | 1 | 1 | 1 | | | | 7 |
| 82 | 1 | | 1 | 1 | 1 | 1 | 1 | 1 | | | | 7 |
| 83 | 1 | 1 | 1 | 1 | 1 | 1 | 1 | 1 | | | | 7 |
| 84 | 1 | 1 | 1 | 1 | 1 | 1 | 1 | 1 | | | | 8 |
| 73 | | 1 | | 1 | 1 | 1 | | | 1 | | | 5 |
| 74 | 1 | | 1 | 1 | | | 1 | | 1 | | | 5 |
| 75 | | 1 | 1 | 1 | | | 1 | | 1 | | | 5 |
| 76 | 1 | 1 | | | 1 | | 1 | | 1 | | | 5 |
| 77 | 1 | | 1 | | 1 | | 1 | | 1 | | | 5 |
| 78 | | 1 | 1 | | 1 | | 1 | | 1 | | | 5 |
| 79 | 1 | | | 1 | 1 | | 1 | | 1 | | | 5 |
| 80 | | 1 | | 1 | 1 | | 1 | | 1 | | | 5 |
| 81 | 1 | 1 | | | | 1 | 1 | | 1 | | | 5 |
| 82 | 1 | | 1 | | | 1 | 1 | | 1 | | | 5 |
| 83 | | 1 | 1 | | | 1 | 1 | | 1 | | | 5 |
| 84 | 1 | | | 1 | | 1 | 1 | | 1 | | | 5 |
| 85 | | 1 | | 1 | | 1 | 1 | | 1 | | | 5 |
| 86 | 1 | | 1 | 1 | | | | 1 | 1 | | | 5 |
| 87 | | 1 | 1 | 1 | | | | 1 | 1 | | | 5 |
| 88 | 1 | 1 | | | 1 | | | 1 | 1 | | | 5 |
| 89 | 1 | | 1 | | 1 | | | 1 | 1 | | | 5 |
| 90 | | 1 | 1 | | 1 | | | 1 | 1 | | | 5 |
| 91 | 1 | | | 1 | 1 | | | 1 | 1 | | | 5 |
| 92 | | 1 | | 1 | 1 | | | 1 | 1 | | | 5 |
| 93 | 1 | 1 | | | | 1 | | 1 | 1 | | | 5 |
| 94 | 1 | | 1 | | | 1 | | 1 | 1 | | | 5 |
| 95 | | 1 | 1 | | | 1 | | 1 | 1 | | | 5 |
| 96 | 1 | | | 1 | | 1 | | 1 | 1 | | | 5 |
| 97 | | 1 | | 1 | | 1 | | 1 | 1 | | | 5 |
| 98 | 1 | 1 | | 1 | | 1 | | 1 | 1 | | | 6 |
| 99 | 1 | | 1 | 1 | | 1 | | 1 | 1 | | | 6 |
| 100 | | 1 | 1 | 1 | | 1 | | 1 | 1 | | | 6 |
| 101 | 1 | 1 | | | 1 | 1 | | 1 | 1 | | | 6 |
| 102 | 1 | | 1 | | 1 | 1 | | 1 | 1 | | | 6 |
| 103 | | 1 | 1 | | 1 | 1 | | 1 | 1 | | | 6 |
| 104 | 1 | | | 1 | 1 | 1 | | 1 | 1 | | | 6 |
| 105 | | 1 | | 1 | 1 | 1 | | 1 | 1 | | | 6 |
| 106 | 1 | | 1 | 1 | | | 1 | 1 | 1 | | | 6 |
| 107 | | 1 | 1 | 1 | | | 1 | 1 | 1 | | | 6 |
| 108 | 1 | 1 | | | 1 | | 1 | 1 | 1 | | | 6 |
| 109 | 1 | | 1 | | 1 | | 1 | 1 | 1 | | | 6 |
| 110 | | 1 | 1 | | 1 | | 1 | 1 | 1 | | | 6 |
| 111 | 1 | | | 1 | 1 | | 1 | 1 | 1 | | | 6 |
| 112 | | 1 | | 1 | 1 | | 1 | 1 | 1 | | | 6 |
| 113 | 1 | 1 | | | | 1 | 1 | 1 | 1 | | | 6 |
| 114 | 1 | | 1 | | | 1 | 1 | 1 | 1 | | | 6 |
| 115 | | 1 | 1 | | | 1 | 1 | 1 | 1 | | | 6 |
| 116 | 1 | | | 1 | | 1 | 1 | 1 | 1 | | | 6 |
| 117 | | 1 | | 1 | | 1 | 1 | 1 | 1 | | | 6 |
| 118 | 1 | 1 | | 1 | | 1 | 1 | 1 | 1 | | | 7 |
| 119 | 1 | | 1 | 1 | | 1 | 1 | 1 | 1 | | | 7 |
| 120 | | 1 | 1 | 1 | | 1 | 1 | 1 | 1 | | | 7 |

*FIG. 4D*

| | | | | | | | | | | | | |
|---|---|---|---|---|---|---|---|---|---|---|---|---|
| 121 | 1 | 1 | | | 1 | 1 | 1 | 1 | 1 | | | 7 |
| 122 | 1 | | 1 | | 1 | 1 | 1 | 1 | 1 | | | 7 |
| 123 | | 1 | 1 | | 1 | 1 | 1 | 1 | 1 | | | 7 |
| 124 | 1 | | | 1 | 1 | 1 | 1 | 1 | 1 | | | 7 |
| 125 | | 1 | | 1 | 1 | 1 | 1 | 1 | 1 | | | 7 |
| 126 | 1 | 1 | | 1 | 1 | 1 | 1 | 1 | 1 | | | 8 |
| 127 | 1 | | 1 | 1 | 1 | 1 | 1 | 1 | 1 | | | 8 |
| 128 | | 1 | 1 | 1 | 1 | 1 | 1 | 1 | 1 | | | 8 |
| 129 | 1 | 1 | 1 | 1 | 1 | 1 | 1 | 1 | 1 | | | 9 |
| 118 | 1 | | 1 | 1 | | | 1 | 1 | | 1 | | 6 |
| 119 | | 1 | 1 | 1 | | | 1 | 1 | | 1 | | 6 |
| 120 | 1 | 1 | | | 1 | | 1 | 1 | | 1 | | 6 |
| 121 | 1 | | 1 | | 1 | | 1 | 1 | | 1 | | 6 |
| 122 | | 1 | 1 | | 1 | | 1 | 1 | | 1 | | 6 |
| 123 | 1 | | | 1 | 1 | | 1 | 1 | | 1 | | 6 |
| 124 | | 1 | | 1 | 1 | | 1 | 1 | | 1 | | 6 |
| 125 | 1 | 1 | | | | 1 | 1 | 1 | | 1 | | 6 |
| 126 | 1 | | 1 | | | 1 | 1 | 1 | | 1 | | 6 |
| 127 | | 1 | 1 | | | 1 | 1 | 1 | | 1 | | 6 |
| 128 | 1 | | | 1 | | 1 | 1 | 1 | | 1 | | 6 |
| 129 | | 1 | | 1 | | 1 | 1 | 1 | | 1 | | 6 |
| 130 | | 1 | | 1 | 1 | 1 | | | 1 | 1 | | 6 |
| 131 | 1 | | 1 | 1 | | | 1 | | 1 | 1 | | 6 |
| 132 | | 1 | 1 | 1 | | | 1 | | 1 | 1 | | 6 |
| 133 | 1 | 1 | | | 1 | | 1 | | 1 | 1 | | 6 |
| 134 | 1 | | 1 | | 1 | | 1 | | 1 | 1 | | 6 |
| 135 | | 1 | 1 | | 1 | | 1 | | 1 | 1 | | 6 |
| 136 | 1 | | | 1 | 1 | | 1 | | 1 | 1 | | 6 |
| 137 | | 1 | | 1 | 1 | | 1 | | 1 | 1 | | 6 |
| 138 | 1 | 1 | | | | 1 | 1 | | 1 | 1 | | 6 |
| 139 | 1 | | 1 | | | 1 | 1 | | 1 | 1 | | 6 |
| 140 | | 1 | 1 | | | 1 | 1 | | 1 | 1 | | 6 |
| 141 | 1 | | | 1 | | 1 | 1 | | 1 | 1 | | 6 |
| 142 | | 1 | | 1 | | 1 | 1 | | 1 | 1 | | 6 |
| 143 | 1 | | 1 | 1 | | | | 1 | 1 | 1 | | 6 |
| 144 | | 1 | 1 | 1 | | | | 1 | 1 | 1 | | 6 |
| 145 | 1 | 1 | | | 1 | | | 1 | 1 | 1 | | 6 |
| 146 | 1 | | 1 | | 1 | | | 1 | 1 | 1 | | 6 |
| 147 | | 1 | 1 | | 1 | | | 1 | 1 | 1 | | 6 |
| 148 | 1 | | | 1 | 1 | | | 1 | 1 | 1 | | 6 |
| 149 | | 1 | | 1 | 1 | | | 1 | 1 | 1 | | 6 |
| 150 | 1 | 1 | | | | 1 | | 1 | 1 | 1 | | 6 |
| 151 | 1 | | 1 | | | 1 | | 1 | 1 | 1 | | 6 |
| 152 | | 1 | 1 | | | 1 | | 1 | 1 | 1 | | 6 |
| 153 | 1 | | | 1 | | 1 | | 1 | 1 | 1 | | 6 |
| 154 | | 1 | | 1 | | 1 | | 1 | 1 | 1 | | 6 |
| 155 | 1 | 1 | | 1 | | 1 | | 1 | 1 | 1 | | 7 |
| 156 | 1 | | 1 | 1 | | 1 | | 1 | 1 | 1 | | 7 |
| 157 | | 1 | 1 | 1 | | 1 | | 1 | 1 | 1 | | 7 |
| 158 | 1 | 1 | | | 1 | 1 | | 1 | 1 | 1 | | 7 |
| 159 | 1 | | 1 | | 1 | 1 | | 1 | 1 | 1 | | 7 |
| 160 | | 1 | 1 | | 1 | 1 | | 1 | 1 | 1 | | 7 |
| 161 | 1 | | | 1 | 1 | 1 | | 1 | 1 | 1 | | 7 |
| 162 | | 1 | | 1 | 1 | 1 | | 1 | 1 | 1 | | 7 |

*FIG. 4E*

| | | | | | | | | | | | | |
|---|---|---|---|---|---|---|---|---|---|---|---|---|
| 159 | 1 | | 1 | | 1 | 1 | | 1 | 1 | 1 | | 7 |
| 160 | | 1 | 1 | | 1 | 1 | | 1 | 1 | 1 | | 7 |
| 161 | 1 | | | 1 | 1 | 1 | | 1 | 1 | 1 | | 7 |
| 162 | | 1 | | 1 | 1 | 1 | | 1 | 1 | 1 | | 7 |
| 163 | 1 | | 1 | 1 | | | 1 | 1 | 1 | 1 | | 7 |
| 164 | | 1 | 1 | 1 | | | 1 | 1 | 1 | 1 | | 7 |
| 165 | 1 | 1 | | | 1 | | 1 | 1 | 1 | 1 | | 7 |
| 166 | 1 | | 1 | | 1 | | 1 | 1 | 1 | 1 | | 7 |
| 167 | | 1 | 1 | | 1 | | 1 | 1 | 1 | 1 | | 7 |
| 168 | 1 | | | 1 | 1 | | 1 | 1 | 1 | 1 | | 7 |
| 169 | | 1 | | 1 | 1 | | 1 | 1 | 1 | 1 | | 7 |
| 170 | 1 | 1 | | | | 1 | 1 | 1 | 1 | 1 | | 7 |
| 171 | 1 | | 1 | | | 1 | 1 | 1 | 1 | 1 | | 7 |
| 172 | | 1 | 1 | | | 1 | 1 | 1 | 1 | 1 | | 7 |
| 173 | 1 | | | 1 | | 1 | 1 | 1 | 1 | 1 | | 7 |
| 174 | | 1 | | 1 | | 1 | 1 | 1 | 1 | 1 | | 7 |
| 175 | 1 | 1 | | 1 | | 1 | 1 | 1 | 1 | 1 | | 8 |
| 176 | 1 | | 1 | 1 | | 1 | 1 | 1 | 1 | 1 | | 8 |
| 177 | | 1 | 1 | 1 | | 1 | 1 | 1 | 1 | 1 | | 8 |
| 178 | 1 | 1 | | | 1 | 1 | 1 | 1 | 1 | 1 | | 8 |
| 179 | 1 | | 1 | | 1 | 1 | 1 | 1 | 1 | 1 | | 8 |
| 180 | | 1 | 1 | | 1 | 1 | 1 | 1 | 1 | 1 | | 8 |
| 181 | 1 | | | 1 | 1 | 1 | 1 | 1 | 1 | 1 | | 8 |
| 182 | | 1 | | 1 | 1 | 1 | 1 | 1 | 1 | 1 | | 8 |
| 183 | 1 | 1 | | 1 | 1 | 1 | 1 | 1 | 1 | 1 | | 9 |
| 184 | 1 | | 1 | 1 | 1 | 1 | 1 | 1 | 1 | 1 | | 9 |
| 185 | | 1 | 1 | 1 | 1 | 1 | 1 | 1 | 1 | 1 | | 9 |
| 186 | 1 | 1 | 1 | 1 | 1 | 1 | 1 | 1 | 1 | 1 | | 10 |
| 175 | 1 | | 1 | 1 | | | 1 | 1 | 1 | | 1 | 7 |
| 176 | | 1 | 1 | 1 | | | 1 | 1 | 1 | | 1 | 7 |
| 177 | 1 | 1 | | | 1 | | 1 | 1 | 1 | | 1 | 7 |
| 178 | 1 | | 1 | | 1 | | 1 | 1 | 1 | | 1 | 7 |
| 179 | | 1 | 1 | | 1 | | 1 | 1 | 1 | | 1 | 7 |
| 180 | 1 | | | 1 | 1 | | 1 | 1 | 1 | | 1 | 7 |
| 181 | | 1 | | 1 | 1 | | 1 | 1 | 1 | | 1 | 7 |
| 182 | 1 | 1 | | | | 1 | 1 | 1 | 1 | | 1 | 7 |
| 183 | 1 | | 1 | | | 1 | 1 | 1 | 1 | | 1 | 7 |
| 184 | | 1 | 1 | | | 1 | 1 | 1 | 1 | | 1 | 7 |
| 185 | 1 | | | 1 | | 1 | 1 | 1 | 1 | | 1 | 7 |
| 186 | | 1 | | 1 | | 1 | 1 | 1 | 1 | | 1 | 7 |
| 187 | 1 | | 1 | 1 | | | 1 | 1 | | 1 | 1 | 7 |
| 188 | | 1 | 1 | 1 | | | 1 | 1 | | 1 | 1 | 7 |
| 189 | 1 | 1 | | | 1 | | 1 | 1 | | 1 | 1 | 7 |
| 190 | 1 | | 1 | | 1 | | 1 | 1 | | 1 | 1 | 7 |
| 191 | | 1 | 1 | | 1 | | 1 | 1 | | 1 | 1 | 7 |
| 192 | 1 | | | 1 | 1 | | 1 | 1 | | 1 | 1 | 7 |
| 193 | | 1 | | 1 | 1 | | 1 | 1 | | 1 | 1 | 7 |
| 194 | 1 | 1 | | | | 1 | 1 | 1 | | 1 | 1 | 7 |
| 195 | 1 | | 1 | | | 1 | 1 | 1 | | 1 | 1 | 7 |
| 196 | | 1 | 1 | | | 1 | 1 | 1 | | 1 | 1 | 7 |
| 197 | 1 | | | 1 | | 1 | 1 | 1 | | 1 | 1 | 7 |
| 198 | | 1 | | 1 | | 1 | 1 | 1 | | 1 | 1 | 7 |
| 199 | | 1 | | 1 | 1 | 1 | | | 1 | 1 | 1 | 7 |

*FIG. 4F*

| | | | | | | | | | | | | |
|---|---|---|---|---|---|---|---|---|---|---|---|---|
| 200 | 1 | | 1 | 1 | | | 1 | | 1 | 1 | 1 | 7 |
| 201 | | 1 | 1 | 1 | | | 1 | | 1 | 1 | 1 | 7 |
| 202 | 1 | 1 | | | 1 | | 1 | | 1 | 1 | 1 | 7 |
| 203 | 1 | | 1 | | 1 | | 1 | | 1 | 1 | 1 | 7 |
| 204 | | 1 | 1 | | 1 | | 1 | | 1 | 1 | 1 | 7 |
| 205 | 1 | | | 1 | 1 | | 1 | | 1 | 1 | 1 | 7 |
| 206 | | 1 | | 1 | 1 | | 1 | | 1 | 1 | 1 | 7 |
| 207 | 1 | 1 | | | | 1 | 1 | | 1 | 1 | 1 | 7 |
| 208 | 1 | | 1 | | | 1 | 1 | | 1 | 1 | 1 | 7 |
| 209 | | 1 | 1 | | | 1 | 1 | | 1 | 1 | 1 | 7 |
| 210 | 1 | | | 1 | | 1 | 1 | | 1 | 1 | 1 | 7 |
| 211 | | 1 | | 1 | | 1 | 1 | | 1 | 1 | 1 | 7 |
| 212 | 1 | | 1 | 1 | | | | 1 | 1 | 1 | 1 | 7 |
| 213 | | 1 | 1 | 1 | | | | 1 | 1 | 1 | 1 | 7 |
| 214 | 1 | 1 | | | 1 | | | 1 | 1 | 1 | 1 | 7 |
| 215 | 1 | | 1 | | 1 | | | 1 | 1 | 1 | 1 | 7 |
| 216 | | 1 | 1 | | 1 | | | 1 | 1 | 1 | 1 | 7 |
| 217 | 1 | | | 1 | 1 | | | 1 | 1 | 1 | 1 | 7 |
| 218 | | 1 | | 1 | 1 | | | 1 | 1 | 1 | 1 | 7 |
| 219 | 1 | 1 | | | | 1 | | 1 | 1 | 1 | 1 | 7 |
| 220 | 1 | | 1 | | | 1 | | 1 | 1 | 1 | 1 | 7 |
| 221 | | 1 | 1 | | | 1 | | 1 | 1 | 1 | 1 | 7 |
| 222 | 1 | | | 1 | | 1 | | 1 | 1 | 1 | 1 | 7 |
| 223 | | 1 | | 1 | | 1 | | 1 | 1 | 1 | 1 | 7 |
| 224 | 1 | 1 | | 1 | | 1 | | 1 | 1 | 1 | 1 | 8 |
| 225 | 1 | | 1 | 1 | | 1 | | 1 | 1 | 1 | 1 | 8 |
| 226 | | 1 | 1 | 1 | | 1 | | 1 | 1 | 1 | 1 | 8 |
| 227 | 1 | 1 | | | 1 | 1 | | 1 | 1 | 1 | 1 | 8 |
| 228 | 1 | | 1 | | 1 | 1 | | 1 | 1 | 1 | 1 | 8 |
| 229 | | 1 | 1 | | 1 | 1 | | 1 | 1 | 1 | 1 | 8 |
| 230 | 1 | | | 1 | 1 | 1 | | 1 | 1 | 1 | 1 | 8 |
| 231 | | 1 | | 1 | 1 | 1 | | 1 | 1 | 1 | 1 | 8 |
| 232 | 1 | | 1 | 1 | | | 1 | 1 | 1 | 1 | 1 | 8 |
| 233 | | 1 | 1 | 1 | | | 1 | 1 | 1 | 1 | 1 | 8 |
| 234 | 1 | 1 | | | 1 | | 1 | 1 | 1 | 1 | 1 | 8 |
| 235 | 1 | | 1 | | 1 | | 1 | 1 | 1 | 1 | 1 | 8 |
| 236 | | 1 | 1 | | 1 | | 1 | 1 | 1 | 1 | 1 | 8 |
| 237 | 1 | | | 1 | 1 | | 1 | 1 | 1 | 1 | 1 | 8 |
| 238 | | 1 | | 1 | 1 | | 1 | 1 | 1 | 1 | 1 | 8 |
| 239 | 1 | 1 | | | | 1 | 1 | 1 | 1 | 1 | 1 | 8 |
| 240 | 1 | | 1 | | | 1 | 1 | 1 | 1 | 1 | 1 | 8 |
| 241 | | 1 | 1 | | | 1 | 1 | 1 | 1 | 1 | 1 | 8 |
| 242 | 1 | | | 1 | | 1 | 1 | 1 | 1 | 1 | 1 | 8 |
| 243 | | 1 | | 1 | | 1 | 1 | 1 | 1 | 1 | 1 | 8 |
| 244 | 1 | 1 | | 1 | | 1 | 1 | 1 | 1 | 1 | 1 | 9 |
| 245 | 1 | | 1 | 1 | | 1 | 1 | 1 | 1 | 1 | 1 | 9 |
| 246 | | 1 | 1 | 1 | | 1 | 1 | 1 | 1 | 1 | 1 | 9 |
| 247 | 1 | 1 | | | 1 | 1 | 1 | 1 | 1 | 1 | 1 | 9 |
| 248 | 1 | | 1 | | 1 | 1 | 1 | 1 | 1 | 1 | 1 | 9 |
| 249 | | 1 | 1 | | 1 | 1 | 1 | 1 | 1 | 1 | 1 | 9 |
| 250 | 1 | | | 1 | 1 | 1 | 1 | 1 | 1 | 1 | 1 | 9 |
| 251 | | 1 | | 1 | 1 | 1 | 1 | 1 | 1 | 1 | 1 | 9 |
| 252 | 1 | 1 | | 1 | 1 | 1 | 1 | 1 | 1 | 1 | 1 | 10 |
| 253 | 1 | | 1 | 1 | 1 | 1 | 1 | 1 | 1 | 1 | 1 | 10 |
| 254 | | 1 | 1 | 1 | 1 | 1 | 1 | 1 | 1 | 1 | 1 | 10 |
| 255 | 1 | 1 | 1 | 1 | 1 | 1 | 1 | 1 | 1 | 1 | 1 | 11 |

METHOD OF DISPLAYING GRAY SCALES OF PLASMA DISPLAY PANEL, AND PLASMA DISPLAY DEVICE

CROSS REFERENCE TO RELATED APPLICATION

This application claims priority to and the benefit of Korean Patent Application No. 10-2004-0037296, filed on May 25, 2004, which is hereby incorporated by reference for all purposes as if fully set forth herein.

BACKGROUND OF THE INVENTION

1. Field of the Invention

The present invention relates to a method of displaying gray scales of a plasma display panel (PDP), and more particularly, relates to a method and apparatus for more accurately expressing gray scales.

2. Description of the Background

Generally, a plasma display device displays characters or images using a PDP, which generates plasma by gas discharge. The PDP may include hundreds of thousands to millions of pixels (discharge cells) arranged in a matrix. PDPs may be direct current (DC) types or alternating current (AC) types according to driving voltage waveform patterns and discharge cell structures.

In a general AC PDP, a single field (1 TV field) may be divided into a plurality of subfields. Each subfield is assigned a weight, and a total of the weights respectively assigned to the plurality of subfields represents gray scales. Examples of a method representing gray scales will be described hereinafter. Assume that a single field is divided into eight subfields SF1 to SF8 and weights assigned to the subfields are 1, 2, 4, 8, 16, 32, 64, and 128, respectively.

In this case, when a discharge cell represents gray scale 1, the discharge cell is turned on in the first subfield SF1 and is turned off in the remaining subfields SF2 to SF8. If a discharge cell represents gray scale 27, the discharge cell is turned on in the first, second, fourth, and fifth subfields SF1, SF2, SF4, and SF5 (1+2+8+16=27). Further, gray scale 255 is represented by turning on the discharge cell from the first subfield to the eighth subfield SF1 to SF8. The gray scale is represented by adding up weights assigned to the subfields having the discharge cells selected to be turned on.

Each subfield of the PDP may include a reset period, an address period, and a sustain period. The address period selects discharge cells to be turned on in a corresponding subfield, and the sustain period sustain-discharges the selected discharge cells during a period corresponding to a weight assigned to the corresponding subfield. Herein, the duration of the sustain period, in other words, the amount of light emitted due to the sustain-discharge during the sustain period, determines weight values. Substantially, the amount of light emission within a single subfield is the sum of the amount of light emitted due to the sustain discharge and an address discharge. For instance, in the case that the amount of light emitted due to the address discharge and the first occurrence of a sustain-discharge is set to be 2 (cd/m$^2$) and the amount of light emitted due to a sustain pulse of one period is set to be 1.4, the amount of light emission for each gray scale is shown in FIG. 1.

Referring to FIG. 1, the amount of light emission for gray scale 7 and gray scale 8 are almost identical, and the amount of light emission for gray scale 15 is greater than the amount of light emission for gray scale 16. When representing gray scale 7, the address discharge occurs three times because the discharge cell is turned on in the first, second, and third subfields, whereas the address discharge occurs once for gray scale 8 because the discharge cell is turned on only in the fourth subfield to represent gray scale 8. However, according to the foregoing assumption, two emissions of the amount of light emitted from the address discharge (1.2) is almost identical to the amount of light emitted due to the sustain discharge (1.4), and therefore gray scales 7 and 8 are represented as almost the same. In like manner, the address discharge occurs four times for gray scale 15, whereas the address discharge occurs once for gray scale 16. Accordingly, the amount of light emission for gray scale 15 is greater than the amount of light emission for gray scale 16, thereby resulting in a reverse gray scale.

Accordingly, in a conventional subfield structure, a gray scale to be displayed on the screen may not always be represented as it is supposed to be when actually displayed on the screen.

SUMMARY OF THE INVENTION

The present invention provides a method of expressing gray scales of a PDP where input gray scales may match output gray scales.

Additional features of the invention will be set forth in the description which follows, and in part will be apparent from the description, or may be learned by practice of the invention.

The present invention discloses a method of expressing gray scales of a plasma display panel representing the gray scales using a sum of weights assigned to a plurality of subfields having discharge cells selected to be turned on, the method including extracting a first gray scale arrangement, including a gray scale n using (k−1) subfields to a gray scale m using k subfields (n<m, n is an integer), from a second gray scale arrangement, including a gray scale I to the gray scale m using k subfields between a 1st subfield and a jth subfield, when a number of subfields used for representing gray scale (i+1) ($1 \leqq i \leqq (m-1)$) is the same or greater than a number of subfields used for representing gray scale i; generating a third gray scale arrangement including a gray scale (n+p) to a gray scale (m+p) by adding a weight p assigned to a (j+1)th subfield to the first gray scale arrangement including the gray scale n to the gray scale m; and generating a fourth gray scale arrangement including the gray scale 1 to the gray scale (m+p) by selecting the second gray scale arrangement in a range from gray scale 1 to a gray scale (n+p−1) and selecting the third gray scale arrangement in a range from the gray scale (n+p) to the gray scale (m+p).

The present invention also discloses a plasma display including a plasma display panel having a plurality of discharge cells, and expressing gray scales by a sum of weights assigned to subfields of a discharge cell selected to be turned on among a plurality of subfields having respective weights, and a controller selecting subfields of the discharge cell selected to be turned on according to an input gray scale. The controller sets a number of subfields used to represent input gray scale (i+1) to be the same or greater than a number of subfields used to represent input gray scale i.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 1 shows the amount of light emission according to gray scales in accordance with a conventional subfield arrangement.

FIG. 3A, FIG. 3B and FIG. 3C show a method of expressing gray scales according to an exemplary embodiment of the present invention.

FIG. 4A, FIG. 4B, FIG. 4C, FIG. 4D, FIG. 4E and FIG. 4F show an exemplarily subfield arrangement determined according to an exemplary embodiment of the present invention.

DETAILED DESCRIPTION OF THE ILLUSTRATED EMBODIMENTS

Figure 2:
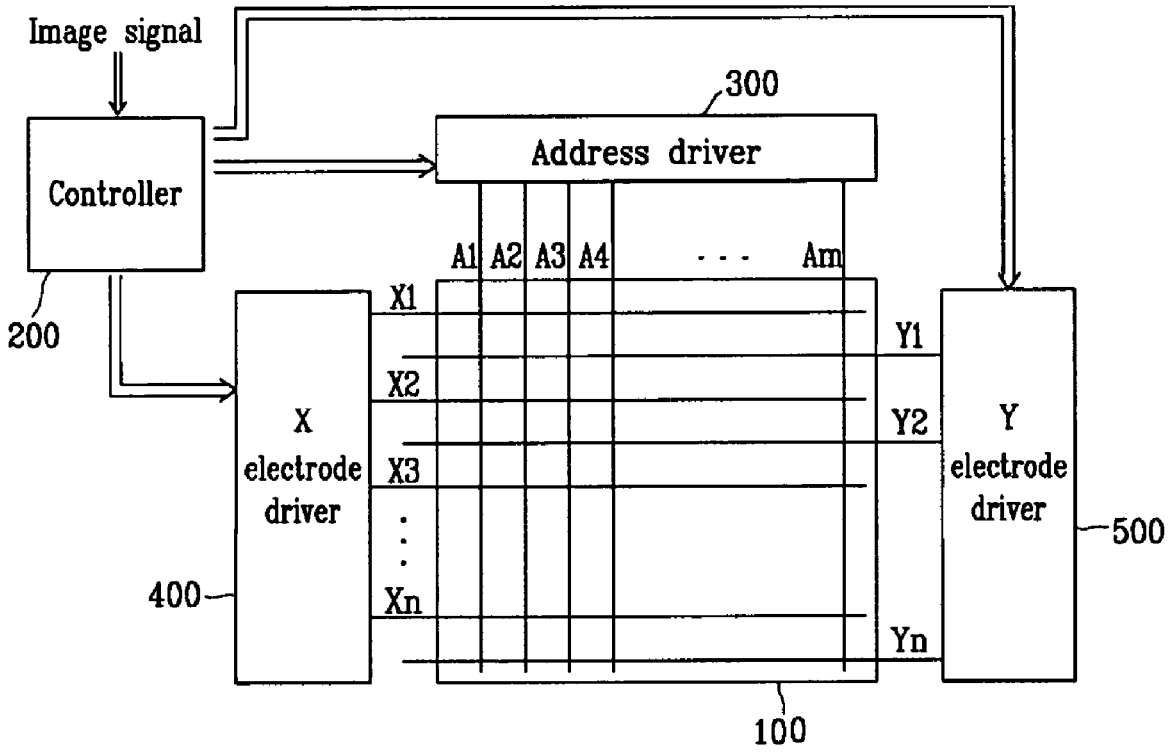
FIG. 2 schematically shows a plasma display device according to an exemplary embodiment of the present invention.

The following detailed description shows and describes only certain exemplary embodiments of the present invention. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

FIG. 2 schematically illustrates a plasma display device according to an exemplary embodiment of the present invention.

Referring to FIG. 2, the plasma display device according to an exemplary embodiment of the present invention may include a PDP 100, a controller 200, an address electrode driver 300, a sustain electrode driver, and a scan electrode driver 500.

The PDP 100 includes address electrodes $A_1$ to $A_m$ arranged in columns, and sustain electrodes $X_1$ to $X_n$ and scan electrodes $Y_1$ to $Y_n$ arranged in rows. The sustain electrodes $X_1$ to $X_n$ correspond to the respective scan electrodes $Y_1$ to $Y_n$, and sustain electrode ends are coupled to each other. Additionally, the PDP 100 includes a front substrate (not shown) on which the sustain electrodes and the scan electrodes ($X_1$ to $X_n$ and $Y_1$ to $Y_n$) are arranged, and a rear substrate (not shown) on which the address electrodes ($A_1$ to $A_m$) are arranged. The front and rear substrates may be made of, for example, glass, and they are sealed together with a discharge space therebetween. The address electrodes $A_1$ to $A_m$ may be substantially orthogonal to the scan electrodes $Y_1$ to $Y_n$ and the sustain electrodes $X_1$ to $X_n$. An intersection between each of the address electrodes $A_1$ to $A_m$ and the scan and sustain electrode $X_1$ to $X_n$ and $Y_1$ to $Y_n$ pairs forms a discharge cell.

The controller 200 selects one or more subfields of a discharge cell selected to be turned on, and generates an address driving control signal, a sustain electrode driving control signal, and a scan electrode driving control signal. Further, the controller 200 adjusts the number of subfields representing gray scale (i+1) to be the same or larger than that of subfields representing gray scale (i).

The address driver 300, the X electrode driver 400, and the Y electrode driver 500 receive a driving control signal from the controller 200, and respectively apply the driving control signal to the address electrodes $A_1$ to $A_m$, the sustain electrodes $X_1$ to $X_n$, and the scan electrode $Y_1$ to $Y_n$ in the respective subfields.

A method of forming subfields by the controller 200 according to an exemplary embodiment of the present invention will be described hereinafter, referring to FIG. 3A, FIG. 3B and FIG. 3C, as well as FIG. 4A, FIG. 4B, FIG. 4C, FIG. 4D, FIG. 4E and FIG. 4F.

Generally, an address discharge occurs in the address period when positive voltages are applied to the address electrodes of discharge cells selected to be turned on and negative voltages are applied to the scan electrodes of the discharge cells. Herein, un-selected scan electrodes may be biased with positive voltages. Accordingly, positive wall charges may form on the scan electrodes and negative wall charges may form on the sustain electrodes of the discharge cells in which the address discharge occurs. Sustain pulses, alternately having a high level voltage and a low level voltage, are alternately applied to the scan electrodes and the sustain electrodes. Herein, phases of the sustain pulse applied to the scan electrode and the sustain electrode are opposite to each other. During the sustain period, applying the high level voltage to the scan electrodes causes a sustain discharge, and then sustain pulses may be repeatedly applied corresponding to weights assigned to the respective subfields, thereby causing the sustain discharge to occur repeatedly. The final sustain discharge may occur in a state that application of the high level voltage to the scan electrode has already proceeded. Here, one period of the sustain pulse is a period during which the sustain pulse applied to the scan electrode (or sustain electrode) has the low level voltage and the high level voltage once. That is, the sustain period comprises a high level voltage applied to the scan electrode and n periods of the sustain pulse (where, n is a positive integer or zero).

For instance, brightness x of a subfield having weight 1 is obtained by adding the brightness by an address discharge and the first sustain discharge, the brightness (x+y) of a subfield having weight 2 is obtained by adding brightness y by the sustain discharges that have occurred during one period of the sustain pulse and the brightness x by the address discharge and the first sustain discharge. Brightness of a subfield having weight 4 is obtained by adding brightness 3*y* by the sustain discharges that have occurred during three periods of the sustain pulse and the brightness x. Therefore, brightness of a subfield having weight j is obtained by adding the brightness x and brightness [(j−1)*y)] by the sustain discharges that have occurred during (j−1) periods of the sustain pulse.

Brightness [L(i)] of gray scale i and brightness [(L(i+1))] of gray scale (i+1) vary depending on weights and the number of associated subfields used to represent gray scales i and (i+1), as known from Equations 1 and 2.

$$L(i)=ax+by \qquad \text{Equation 1}$$

where x is the brightness by an address discharge and the first sustain discharge, y is brightness by a sustain pulse of one period, a is the number of subfields used to represent gray scale i, and b is the total periods of the sustain pulse in the subfields used to represent gray scale i.

$$L(i+1)=cx+dy \qquad \text{Equation 2}$$

where c is the number of subfields used to represent gray scale (i+1), and d is the total periods of the sustain pulse in the subfields used to represent gray scale (i+1).

Equation 3 provides the brightness difference between gray scales (i+1) and i. Equation 3 may be calculated as Equation 4 when (a+b) is smaller than (c+d).

$$L(i+1)-L(i)=(c-a)x+(d-b)y \qquad \text{Equation 3}$$

$$L(i+1)-L(i)=(c-a)x+(a-c+e)y=(c-a)(x-y)-ey \quad \text{Equation 4}$$

where e is (c+d)−(a−b), which becomes greater than 0.

When brightness of x and y are the same, a difference between L(i+1) and L(i) becomes a positive number, and thus gray scales are not reversed. However, when a large difference exists between the brightness of x and y, a value of (c−a) may cause gray scales to be reversed. Thus, the value of (c−a) may be set as shown in Equation 5 to prevent gray scales from being reversed.

$$c-a=0, \text{ or } c-a=1 \quad \text{Equation 5}$$

Referring to FIG. 3A, FIG. 3B and FIG. 3C, a method of determining weights of subfields to satisfy Equation 5 will be described in detail.

As shown in FIG. 3A, firstly, weights assigned to the first subfield SF1 and the second subfield SF2 are set to be 1 and 2, respectively. Assume that the weight of the third subfield is set to be 4. In this case, one subfield (subfield SF3) is turned on to represent the gray scale 4, whereas two subfields (subfields SF1 and SF2) are turned on to represent the gray scale 3. Accordingly, this assumption does not satisfy Equation 5. Therefore, the weight of the third subfield is set to be 3.

Further, assume that the weight assigned to the fourth subfield SF4 is set to be 6. However, this assumption also does not satisfy Equation 5 because the gray scale 6 uses the subfields from the first to the third SF1 to SF3 whereas the gray scale 7 uses the first subfield SF1 and the fourth subfield SF4. Therefore, the weight of the fourth subfield SF4 may be set to be 4 or 5. Herein, when the weight of the fourth subfield SF4 is set to be 4, the weight of the fifth subfield SF5 may be set to be 6 or 7. Alternatively, when the weight of the fourth subfield SF4 is set to be 5, the weight of the fifth subfield SF5 may be set to be 7 or 8.

For instance, when the weight of the fourth subfield SF4 is set to be 5, gray scales 0 to 11 can be represented by incrementing the number of subfields using the first subfield SF1 to the fourth subfield SF4. However, the number of subfields representing gray scale 11 increases by 1 as compared to the number of subfields representing gray scale 10, and thus weight of the fifth subfield SF5 is set to represent gray scale 11 using three subfields with combinations of the first to the fourth subfields SF1 to SF4 and the fifth subfield SF5. Herein, gray scales 11 to 18 can be represented by respectively adding 8 to the gray scales 3 to 10 since the gray scales 3 to 10 use two or three subfields. In other words, the weight of the fifth subfield SF5 is set to be 8, and the gray scales 11 to 18 are represented by the combination of the subfields used to represent the gray scales 3 to 10 and the fifth subfield SF5. According to the foregoing method, gray scales 0 to 18 can be represented without reducing the number of subfields.

Gray scale 19 can also be represented by adding the weight assigned to the sixth subfield SF6 to gray scales using three subfields to represent the gray scale instead of using five subfields SF1 to SF5. In other words, as shown in FIG. 3B, gray scales 19 to 29 can be represented by adding 11 to the gray scales that use three or four subfields (gray scales 8 to 18). Thus, setting the weight of the sixth subfield SF6 to 11 may prevent reverse gray scales.

On the other hand, as shown in FIG. 3C, gray scales 16 to 27 can be represented by removing the gray scales using four subfields in FIG. 3A (gray scales 16 to 18), and adding 12 to gray scales using two or three subfields (gray scales 4 to 15), and thereby to represent gray scales 16 to 27 using three or four subfields. In other words, the weight assigned to the sixth subfield SF6 can be set to be 12.

In a like manner, further gray scales also can be represented by setting weights for subfields without reducing the number of subfields to be used.

FIG. 4A, FIG. 4B, FIG. 4C, FIG. 4D, FIG. 4E and FIG. 4F show an exemplarily subfield arrangement according to an embodiment of the present invention. Shaded portions of the Figures show gray scales that are represented by a weight assigned to a newly added subfield and previous subfields, but these gray scales therein are not substantially used.

Referring to FIGS. 4A to 4F, weights of the first to third subfields SF1 to SF3 are respectively set to be 1, 2, and 3, and the weight assigned to the fourth subfield SF4, which is 5, is added to the gray scales 1 to 5 to represent gray scales 6 to 10. Gray scales 11 to 18 are represented by adding weight 8 to the gray scales 3 to 10 using two or three subfields, and gray scales 16 to 18 using four subfields are removed. Then, weight 13 is added to the gray scales 3 to 15 using two or three subfields to represent the gray scales 16 to 18. Then, the weight 13 is added again to the gray scales 3 to 15 using two or three subfields so as to represent gray scales 16 to 28. Weight 20 is added to the gray scales 9 to 28 using three or four subfields to represent gray scales 29 to 48, and the gray scales 41 to 48 using five subfields are removed. Weight 32 is added to the gray scales 9 to 40 using three or four subfields so as to represent gray scales 41 to 72.

Gray scales 73 to 117 are represented by adding weight 45 to the gray scales 28 to 72 using four or five subfields, and gray scales 118 to 174 are represented by adding weight 57 to the gray scales 61 to 117 using five or six subfields. Weight 69 is added to the gray scales 106 to 174 using six or seven subfields to represent gray scales 175 to 243, and gray scales 244 to 255 are represented by using the remaining subfields.

To satisfy Equation 5, the following rule may be applied to represent weights and gray scales of each subfield according to an embodiment of the embodiment of the present invention.

First, assume that there is a first gray scale arrangement with 1 to k subfields that does not decrement the number of subfields although levels of gray scales increase. In other words, gray scales 0 to f are represented by 1 to k subfields, and the number of subfields used to represent gray scale (i+1) is the same as, or one greater than, the number of subfields used to represent gray scale i.

Herein, when a range of gray scale levels extends by adding a $(k+1)^{th}$ subfield, gray scales (a range of gray scales g to f, where g is smaller than f, and the gray scale f is represented using less than (k−1) subfields) beyond a predetermined gray scale level using less than k subfields in the first gray scale arrangement are selected as a second gray scale arrangement. A third gray scale arrangement ranges from gray scales (g+h) to (f+h) by adding the weight h assigned to an additional subfield. For instance, the gray scales 29 to 48 in FIG. 4 are represented by adding the weight 20 to the gray scales 9 to 28 (herein, h is set to be 20, g to be 9, and f to be 28).

Herein, the number of subfields used to represent gray scale (g+h) may be reduced when the gray scale (g+h) uses two more subfields than gray scale g so that the gray scale (g+h) may use one more subfield than the gray scale g. Therefore, the weight assigned to the additional subfields may be the same or smaller than the total number of gray scales using the same number of subfields as the gray scale g and gray scales using one more subfield compared to the gray scale g in the second gray scale arrangement. In other words, assume that a total number of gray scales using the same number of subfields as the gray scale g within a range of gray scales g to f, is set to be N1, and a total number of gray scales using one more subfield than the gray scale g is set to be N2. In this case, weight h assigned to the additional subfields must satisfy Equation 6.

$$h<N1+N2 \quad \text{Equation 6}$$

The third gray scale arrangement including the gray scale (g+h) to (f+h) is joined to the first gray scale arrangement. Herein, when the gray scale (g+h) is included in the first gray scale arrangement, a new arrangement of gray scales may be generated from the gray scale (g+h) by applying the third gray scale arrangement thereto.

By repeating the foregoing methods, gray scale levels can be increased without reducing the number of subfields to be used to represent the gray scale levels.

According to the present invention, input gray scales and output gray scales are matched with each other to prevent reverse gray scales.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of expressing gray scales of a plasma display panel representing the gray scales using a sum of weights assigned to a plurality of subfields, the method comprising:

extracting a first gray scale arrangement, including a gray scale n using (k−i) of the subfields to a gray scale m using k of the subfields (n <m, n is an integer), from a second gray scale arrangement, including a gray scale 1 to the gray scale m using k of the subfields between a 1st subfield and a jth subfield, when a number of subfields used for representing gray scale (i+1) ($1 \leqq i \leqq (m-1)$) is the same or greater than a number of subfields used for representing gray scale i;

generating a third gray scale arrangement including a gray scale (n+p) to a gray scale (m+p) by adding a weight p assigned to a (j+1)th subfield to the first gray scale arrangement including the gray scale n to the gray scale m;

generating a fourth gray scale arrangement including the gray scale 1 to the gray scale (m+p) by selecting the second gray scale arrangement in a range from gray scale 1 to a gray scale (n+p−1) and selecting the third gray scale arrangement in a range from the gray scale (n+p) to the gray scale (m+p); and selecting a discharge cell to be turned on and sustain discharging the turned on cell to display the gray scale 1 to the gray scale (m+p) using the fourth gray scale arrangement, wherein the number of subfields used to represent a first gray scale between the gray scale 1 and the gray scale (m+p) is always equal to or less than the number of subfields used to represent a second gray scale, the second gray scale equaling the first gray scale plus one.

2. The method of claim 1, wherein the weight p assigned to the (j+1)th subfield is the same or smaller than a total number of gray scales using the same number of subfields as the gray scale n and gray scales using one more subfield compared to the gray scale n in the first gray scale arrangement.

3. The method of claim 1, wherein the fourth gray scale arrangement is set as the second gray scale arrangement, and (a), (b), and (c) are repeated.

4. The method of claim 1, wherein weights for a first subfield, a second subfield, and a third subfield are set to be 1, 2, and 3, respectively.

5. The method of claim 4, wherein a weight for a fourth subfield is set to be 4.

6. The method of claim 5, wherein a weight for a fifth subfield is set to be either 6 or 7.

7. The method of claim 4, wherein a weight for a fourth subfield is set to be 5.

8. The method of claim 7, wherein a weight for a fifth subfield is set to be either 7 or 8.

9. A plasma display device, comprising:

a plasma display panel having a plurality of discharge cells, and expressing gray scales by a sum of weights assigned to subfields of a discharge cell selected to be turned on among a plurality of subfields having respective weights; and a controller selecting subfields of the discharge cell selected to be turned on according to an input gray scale and setting a number of subfields used to represent input gray scale (i+1) to always be the same or greater than a number of subfields used to represent input gray scale 1, wherein the controller extracts a first gray scale arrangement, including a gray scale n using (k−1) of the subfields to a gray scale m using k of the subfields (n <m, n is an integer), from a second gray scale arrangement, including gray scale 1 to gray scale m using k subfields between the first subfield and fifth subfields, and sets a value to be a weight for a sixth subfield, wherein the value is the same or smaller than a total number of gray scales using the same number of subfields as the gray scale n and gray scales using one more subfield compared to the gray scale n in the first gray scale arrangement, and the value is the same or greater than a value set to be a weight for the fifth subfield.

10. The plasma display device of claim 9, wherein weights for a first subfield, a second subfield, a third subfield, a fourth subfield, and a fifth subfield are 1, 2, 3, 4, and 6, respectively.

11. The plasma display device of claim 9, wherein weights for a first subfield, a second subfield, a third subfield, a fourth subfield, and a fifth subfield are 1, 2, 3, 4, and 7, respectively.

12. The plasma display device of claim 9, wherein weights for a first subfield, a second subfield, a third subfield, a fourth subfield, and a fifth subfield are 1, 2, 3, 5, and 7, respectively.

13. The plasma display device of claim 9, wherein weights for a first subfield, a second subfield, a third subfield, a fourth subfield, and a fifth subfield are 1, 2, 3, 5, and 8, respectively.

14. The plasma display device of claim 9, wherein the controller generates a third gray scale arrangement by adding the weight for the sixth subfield to the first gray scale arrangement, and represents the third gray scale arrangement and the gray scale 1 to a preceding gray scale of the first gray scale arrangement in the third gray scale arrangement by selecting the first gray scale arrangement.

15. The plasma display device of claim 9, wherein the controller sets the number of subfields used to represent the input gray scale (i+1) to be the same as, or one more than, the number of subfields used to represent the input gray scale i.

* * * * *